United States Patent [19]

Gapper et al.

[11] 4,006,935

[45] Feb. 8, 1977

[54] MINING MACHINES

[75] Inventors: Terence John Gapper, Duffield; George Thomas Addison; David Arthur Tate, both of Burton-on-Trent, all of England

[73] Assignee: Coal Industry (Patents) Limited, London, England

[22] Filed: May 19, 1975

[21] Appl. No.: 578,868

[30] Foreign Application Priority Data

May 17, 1974 United Kingdom ..... 22036/74

[52] U.S. Cl. ..... 299/1; 299/43

[51] Int. Cl.[2] ..... E21C 25/10

[58] Field of Search ..... 299/1, 43; 33/1 M

[56] References Cited

UNITED STATES PATENTS

| | | | |
|---|---|---|---|
| 2,761,666 | 9/1956 | Heimaster et al. | 299/1 |
| 2,886,299 | 5/1959 | Heimaster et al. | 299/1 |
| 3,108,789 | 10/1963 | Heimaster et al. | 299/1 |
| 3,371,964 | 3/1968 | Weber | 299/1 |
| 3,832,781 | 9/1974 | Flagge | 33/1 M |

FOREIGN PATENTS OR APPLICATIONS

| | | | |
|---|---|---|---|
| 1,193,178 | 5/1970 | United Kingdom | 299/1 |

*Primary Examiner*—Ernest R. Purser
*Assistant Examiner*—William F. Pate, III
*Attorney, Agent, or Firm*—Stevens, Davis, Miller & Mosher

[57] ABSTRACT

A ranging arm shearer mining machine has sensing means for sensing the position of the rotational axis of a cutter drum mounted on the ranging arm relative to the pivotal axis of the arm.

5 Claims, 4 Drawing Figures

MINING MACHINES

The present invention relates to mining machines and in particular to mining machines including cutter means carried on pivotally mounted booms or arms.

One known such mining machine is commonly called a ranging drum shearer and comprises at least one rotary cutter drum carried on an arm pivotally mounted on the machine body. The arm is pivoted about its pivotal mounting by a hydraulic jack which controls the angular position of the arm to raise or lower the cutter drum to a desired height. In coal mining practice a machine having a single rotary cutter traverses to and fro along a working face winning a strip of coal from the working face every two traverses. The thickness of coal won on each strip is typically somewhat less than twice the cutting diameter of the cutter drum so that on one traverse the machine wins coal adjacent the mine roof and on the following traverse wins coal adjacent to the mine floor.

With a prior known ranging drum shearer the cutter drum is raised or lowered to steer the machine by an operator who has to estimate the cutting horizon of the cutter drum. As the operator is remote from the cutter drum which is surrounded by dust generated during cutting, the steering is often erratic resulting in roof and/or floor rock being mined or in an excessive amount of coal being left unmined.

Techniques have been proposed for automatically steering ranging drum shearers using well known systems developed with fixed drum shearers i.e. machines having the axis of the cutter drums fixed with respect to the machine body. However, because of the problems encountered with determining the vertical position of the ranging cutter drum with respect to the machine body the proposed techniques have not yet been fully developed.

An object of the present invention is to provide an improved ranging drum machine which overcomes or reduces the above problems.

According to the present invention a mining machine comprises a body including a pivotal mounting for an arm adapted to pivot about a first axis relative to the pivotal mounting, a driven gear mechanism associated with the arm and adapted to drivably engage a rotary cutter drum which in use is carried by the arm for rotation about a second axis, and sensing means adapted to sense the rotation or position of one of the said axes with respect to the other of said axes.

Preferably, the sensing means is adapted to sense the position of the said second axis with respect to the said first axis.

Preferably, the sensing means is adapted to sense the perpendicular distance of the said second axis from a plane including the said first axis and extending longitudinally of the machine.

Conveniently, the two axes are substantially horizontal and the sensing means is adapted to sense the height of the second axis relative to the said plane.

Conveniently, the sensing means senses the pivotal movement of the arm about its pivotal mounting.

Preferably, the sensing means includes a rotary potentiometer which is mounted along the said first axis and a portion of which is rotated by the pivotal movement of the arm.

Preferably, the rotary potentiometer is a sine-cosine potentiometer arranged to derive a signal indicative of the height of the second axis with respect to the first axis.

By way of example only, one embodiment of the present invention will be described with reference to the drawings accompanying the Provisional Specification in which.

Figure 1:
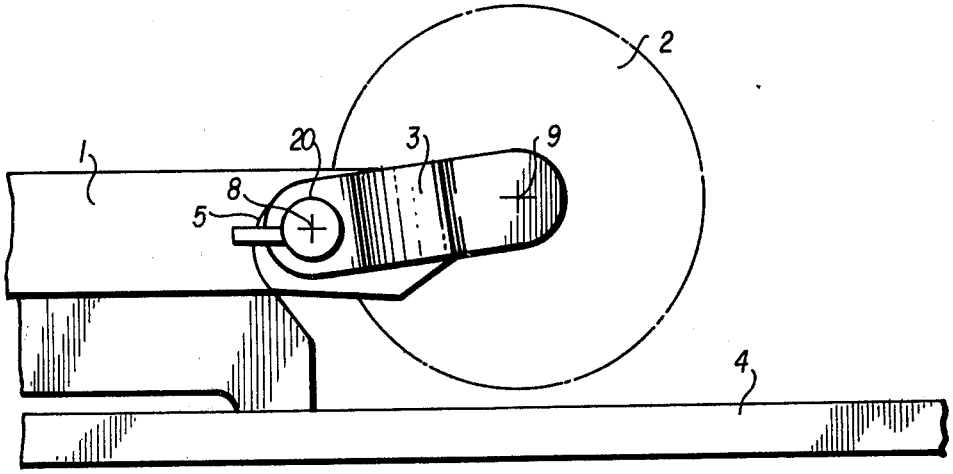
FIG. 1 is a side view of a part of a mining machine.
Figure 2:
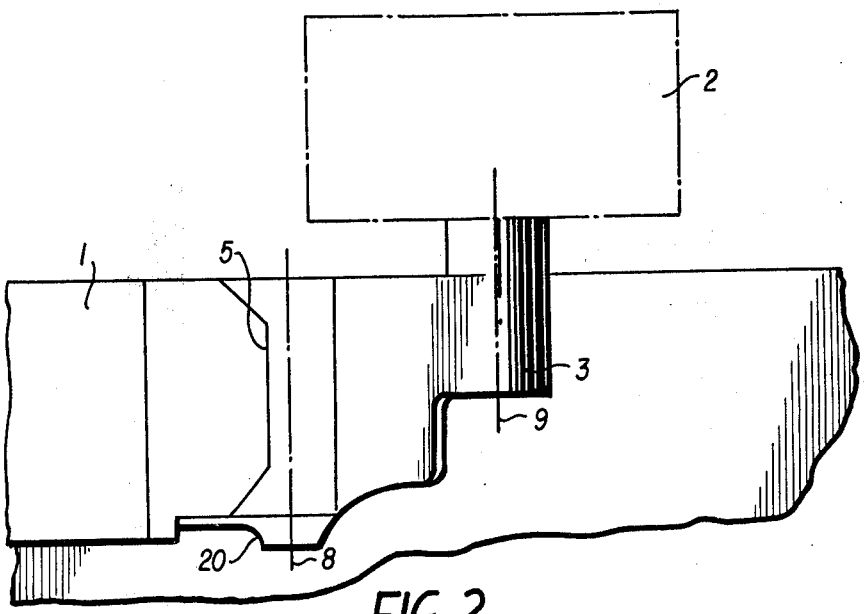
FIG. 2 is a plane of FIG. 1.

FIGS. 1 and 2 show a part of a ranging drum shearer coal mining machine which comprises a body 1 (only a portion of which is shown) and a rotary cutter drum 2 mounted on an arm 3 and which in use repeatedly traverses to and fro along an armoured face conveyor 4 extending along a longwall coal face such that the rotating cutter drum wins and loads coal from the face. The arm 3 is supported in a pivotal mounting 5 for pivotal movement about an axis 8, the pivotal movement being controlled by a hydraulic jack (not shown). An electric drive motor housed within the body of the machine is drivably connected to a gear mechanism extending along the arm to drivably engage the cutter drum which thereby is rotated about an axis 9.

The arrangement is such that as the machine traverses along the face in one direction the cutter drum is raised to the mine roof and as the machine traverses along the face in the opposite direction the cutter drum is lowered to the mine floor. Usually, a nucleonic sensing probe is mounted on the machine to sense the mine roof to determine the thickness of a coal band left adjacent the upper rock seam boundary and to feed a signal indicative of the coal band thickness to control means which control the steering of the machine. The control means also receive and act on signals indicative of other parameters associated with the position of the cutter drum to ensure that the cutter drum is maintained on a desired cutting horizon. These parameters include the height of the cutter drum relative to a reference plane extending longitudinally of the machine. For convenience the reference plane selected is that including the axis 8.

Figure 3:
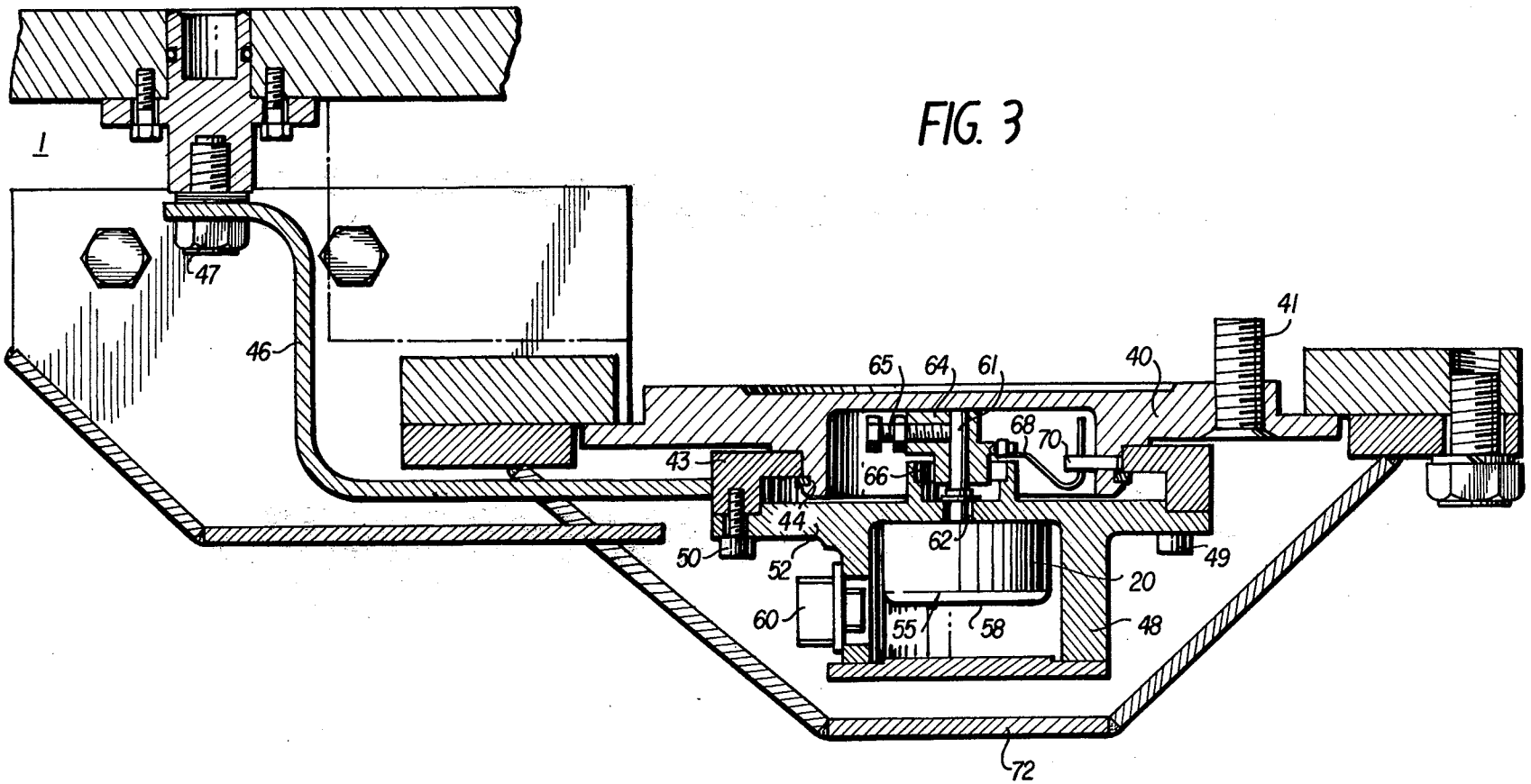
FIG. 3 is a sectional view of a detail of the mining machine of FIG. 1, on an enlarged scale.
Figure 4:
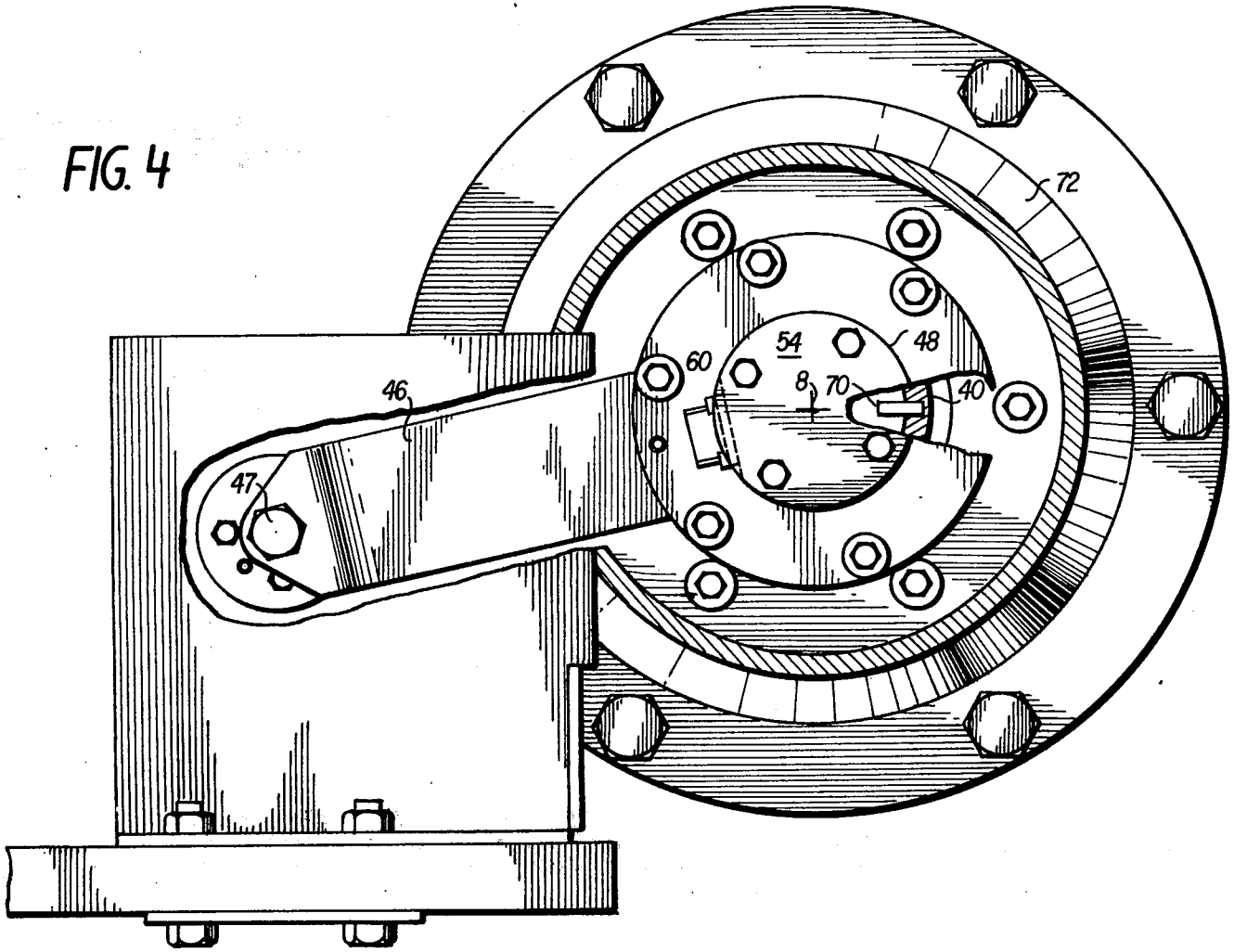
FIG. 4 is a side view of the detail of FIG. 2 with a part of a cover plate cut away.

The present embodiment provides sensing means 20 which senses the perpendicular distance of the axis 9 from the plane including the axis 8 and extending longitudinally of the machine. The sensing means is shown in detail in FIGS. 3 and 4 and comprises a plate 40 fixedly secured by bolts 41 to arm 3 for pivotal movement with the arm about the axis 8. The plate 40 has an annular bearing surface for engagement by a ring 43 which is retained in the engaged position on the bearing surface by a retaining clip 44 and which is anchored to the machine body 1 by an arm 46 rigidly bolted to the machine body by a bolt 47. Thus, when the arm 3 pivots the plate 40 rotates relative to the ring 43. A cylindrical housing 48 is fixedly secured to the ring 43 by a ring of bolts 49 engaged in bores 50 formed in a flange plate 52 forming one end of the housing 48. The other end of the housing 48 is closed by a cap 54. A sine-cosine rotary potentiometer 55 is mounted within the housing 48 such that its outer cover 58 is fixed to the housing 48, the space between the outer cover 58 and the inner walls of the housing 48 is filled with a suitable potting material to insulate and protect the potentiometer against moisture or fine rock material which in use may otherwise have entered the housing. An electrical circuit board (not shown) is also mounted within the potting material and is arranged to receive an electric signal from the potentiometer and to feed the signal to an electrical plug (not shown) connected to the socket 60 provided in the housing walls.

A rotary spindle 61 extends from the potentiometer through a bore 62 formed in the flange plate 52 along the axis 8 and is fixedly connected to a bush 64 by a locking bolt 65. The bush is rotatably supported by a bearing 66 provided in an annular spigot extending from the flange plate 52. An arm 68 extends outwards from the bush 64 and fixedly engages a peg 70 fixedly accommodated in a bore formed in the plate 40. The arrangement is such that the spindle 61 rotates about its axis which is coincident with the axis 8 when the arm 3 pivots.

The arm 68 is resilient in the direction towards the peg 70 and is provided with a recessed forked end for accommodating the peg 70. Thus, the arm 68 is urged into the recess and into contact with the peg and therefore no lost motion occurs between the peg and the arm.

The sensing means is protected by a cover plate assembly 72 bolted to the machine body and to the arm.

In use, when the arm 3 is pivoted to raise or lower the cutter drum 2, the spindle 61 is rotated through an angle equal to the angular movement of the arm, the spindle being rotated by movement of the arm 68 which fixedly engages the bush 64 and the peg 70 which in turn is fixedly located in the plate 40 rotatable with the arm 3.

Rotary movement of the spindle 61 is sensed by the sine-cosine potentiometer 55 which is set to feed a signal to the previously mentioned electrical circuit board indicative of the perpendicular distance of the cutter drum axis 9 from the plane including the pivot axis 8 and extending longitudinally of the machine. This signal is fed through the socket connection 60 to the steering control means which thereby steer the cutter drum in accordance with this sensed parameter along with other sensed parameters.

Thus, it is possible to steer the cutter drum along a desired cutting horizon.

We claim:

1. A mining machine, comprising: a body; an arm mounted to said body for pivotal movement relative to said body about a first substantially horizontal axis; a rotary cutter drum carried by said arm and mounted for rotation about a second substantially horizontal axis; sensing means, including a rotary sine-cosine potentiometer means coupled to said arm for sensing a displacement of said arm corresponding to the height of said second axis relative to a plane containing said first axis, said potentiometer means generating a signal directly related to the sensed relative height; a first member secured to said arm and having an annular bearing surface; a second member engaging said annular bearing surface of said first member, said first member being rotatable relative to said second member; said potentiometer having a rotating spindle, said potentiometer being mounted to said second member such that said spindle is co-axial with said first axis; and a further arm secured to said spindle and engaging said first member to rotate said spindle through an angle substantially equal to angular movement of said arm.

2. The mining apparatus according to claim 1, wherein said second member is inhibited from rotational movement with said arm.

3. The mining apparatus according to claim 2, wherein said second member is secured to said body.

4. A mining machine, comprising: a body; an arm mounted to said body for pivotal movement relative to said body about a first substantially horizontal axis; a rotary cutter drum carried by said arm and mounted for rotation about a second substantially horizontal axis; sensing means, including a rotary sine-cosine potentiometer means coupled to said arm for sensing a displacement of said arm corresponding to the height of said second axis relative to a plane containing said first axis, said potentiometer means generating a signal directly related to the sensed relative height; a housing containing said potentiometer means, the space between said housing and potentiometer means containing an insulating and protective potting material; a first bearing plate on said arm; and a second bearing plate engaging said first bearing plate and fixed with respect to said body; wherein said potentiometer means includes a rotary spindle fixed with respect to said first bearing plate and wherein said housing is fixed with respect to said body.

5. A machine as claimed in claim 4, in which the spindle is attached to the first bearing plate by resilient means to ensure no lost motion occurs between rotation of the arm and the spindle.

* * * * *